United States Patent [19]

Pohl et al.

[11] Patent Number: 4,750,553

[45] Date of Patent: Jun. 14, 1988

[54] HEAT EXCHANGER FOR COOLING SOLID SUBSTANCE-CONTAINING GAS

[75] Inventors: Hans C. Pohl, Witten; Friedrich W. Kloster, Essen; Eberhard Schlag, Bottrop-Kirchhellen, all of Fed. Rep. of Germany

[73] Assignee: Krupp-Koppers GmbH, Essen, Fed. Rep. of Germany

[21] Appl. No.: 910,479

[22] Filed: Sep. 22, 1986

[30] Foreign Application Priority Data

Nov. 27, 1985 [DE] Fed. Rep. of Germany ..... 3541887

[51] Int. Cl.[4] ..... F28F 19/00

[52] U.S. Cl. ..... 165/134.1; 165/174

[58] Field of Search ..... 165/174, 178, 134.1

[56] References Cited

U.S. PATENT DOCUMENTS

| | | | |
|---|---|---|---|
| 1,429,149 | 9/1922 | Lawrence | 165/174 |
| 2,105,267 | 1/1938 | Robertson | 165/178 X |
| 4,126,016 | 11/1978 | Griener | 165/2 X |
| 4,295,519 | 10/1981 | Bellaff | 165/921 X |
| 4,457,364 | 7/1984 | Di Nicolantonio | 165/134.1 |

FOREIGN PATENT DOCUMENTS

| | | | |
|---|---|---|---|
| 657100 | 5/1929 | France | 165/174 |
| 82389 | 8/1956 | Netherlands | 165/174 |
| 14149 | of 1915 | United Kingdom | 165/174 |
| 634608 | 3/1950 | United Kingdom | 165/174 |
| 348848 | 9/1972 | U.S.S.R. | 165/174 |

*Primary Examiner*—Albert W. Davis, Jr.
*Attorney, Agent, or Firm*—Michael J. Striker

[57] ABSTRACT

A heat exchanger for cooling solid substance-containing gases comprises a plurality of heat exchanging tubes through which gases flow. An intake nozzle of a trumpet-shaped configuration is coaxially mounted on and connected to the end portion of each heat exchanger tube. A locking device is provided to connect the intake nozzle to the respective tube.

6 Claims, 2 Drawing Sheets

Fig. 1 (I-I)
A
B
α
R
H
$d_H$
$d_o$
1
2
3
4
4'
5
6
7
8
9
10
11
12
13

HEAT EXCHANGER FOR COOLING SOLID SUBSTANCE-CONTAINING GAS

BACKGROUND OF THE INVENTION

The present invention relates to a heat exchanger for cooling solid substance-containing gases, particularly gases discharged from a carbon gasification plant which has a plurality of heat exchange tubes through which gases pass and which tubes are connected at a gas inlet and gas outlet side to the tube bases.

During the carbon gasification at high temperatures a raw gas is generated which contains solid particles. These solid particles are combined from non-gasified carbon particles, carbon ash and slag particles. Before solid substance can be removed from gas this gas having the temperature higher than 1000° C. must be firstly cooled down. Cooling of the gas is also required because usual processes for the desulfurizing of the gas have been performed at temperatures 150° C.

In order to efficiently utilize heat produced by a hot raw gas stream the gas is conveyed through the heat exchanger where the gas transmits a part of its heat to a heat-receiving agent. In these conditions a tubular heat exchanger is preferable. Water is utilized as a heat-receiving agent, whereby steam is produced. The solid substance-containing gas is fed through the heat exchanger tubes whereas the boiler feed water is accommodated in the space between the outer sleeve of the heat exchanger and the outer side of the heat exchanger tubes. It is also possible to utilize wet steam as a heat-receiving agent and generate an overheated steam by heat exchange from the hot gas stream. It is also possible to utilize remaining gases or liquids other than water as heat-receiving agents.

During the feeding of gas through the heat exchanger tubes the speed of gas is selected so that the inner walls of the tubes are not contaminated by deposits and thus heat transmission ratios can not substantially change during the operation of the heat exchanger. Speeds between 20 and 50 m/s for adjusting desired heat transmission ratios and self-cleaning of the heat exchanger have been defined as suitable.

An inflow gas must at the gas inlet side of the heat exchanger, be distributed between individual heat exchange tubes. This gas is subject to direction changes and accelerations which can damage a uniform stream formation at the intake portions of the heat exchanger tubes. The length of the intake portion which is the extension between the inlet into the tube and the place of formation of a homogeneous tubular stream is the greater the more unfavorably-shaped is the tube intake portion. Unfavorable are abrupt cross-sections and changes in directions while favorable are channel shapes which ensure moderate accelerations and prevent transversal components in the stream.

When solid substance is present in the gas stream this leads to strong abrasion or erosion on the inner sides of the tubes, caused by unfavorable stream ratios due to non-laminar flows because of changes in directions, recirculation and flowing about corners and edges of the tubes. This indicates that particularly in the intake regions of the heat exchanger tubes, such cracks occur that can cause considerable reductions in the thickness of the tube in this region so that the operation of the heat exchanger becomes no longer reliable.

The tubes must be then closed which leads to blocking of efficient heat exchange surfaces and to increase of the stream speed in the operating heat exchanger tubes. Higher speed of the stream causes increase in wear and thereby shortening of the service life of the heat exchanger.

As soon as a greater part of the heat exchanger tubes is worn off as described above the heat exchanger must be provided with new tubing. It is however unsatisfactory that with tubes 7 m long wear takes place at the length of about 400 mm from the intake of the tube so that the remaining part of the tube is not damaged at all.

It has been proposed to extend intervals between replacements of the worn-off tubing with a new one by provision of insertion sleeves, also tubular, which have the outer diameter adjusted to the inner diameter of the heat exchanger tubes and which can be displaced along the place being damaged and thus cover the same. It has been discovered however that abrasion can occur immediately behind the end of the insertion sleeve due to sudden thickness enlargements, non-laminar stream with a vortex formation and recirculation. These insert sleeves can be eventually replaced with new insert sleeves which can be longer and which would overlap the entire area to be closed; these longer sleeves however have limited heat exchange properties.

SUMMARY OF THE INVENTION

It is an object of the present invention to provide an improved heat exchanger for cooling gases containing solids.

It is another object of the invention to provide a heat exchanger in which wear in the region of the intake of each heat exchanger tube will be reduced to minimum.

These and other objects of the invention are attained by a heat exchanger for cooling solid substance-containing gases particularly gases discharged from a carbon-gasification plant, comprising a plurality of heat exchange tubes through which gases flow; tube bases into which said heat exchanger tubes are inserted at a gas inlet side and gas outlet side; and a plurality of intake nozzles each mounted coaxially with and set on a respective heat exchanger tube at said gas inlet, each nozzle having an inner diameter at a portion thereof set on the heat exchanger tube equal to the inner diameter of the heat exchanger tube, each nozzle starting from said portion widening in the direction opposite to a direction of gas flow up to a place of contact with all adjacent nozzles so as to form a trumpet-shaped portion, whereby the formation of areas of dammed water perpendicular to said direction is substantially prevented.

The trumpet-shaped portion may include with the direction of the stream of the solid-substance containing gases an angle which does not exceed 14°. Such an angle, on the one hand, ensures a very little erosion. On the other hand, such an angle ensures satisfactory structural length of the intake nozzle whereas the flat angle although causing little erosion would cause extensive structural lengths of the nozzles.

In order to minimize erosion it is also advantageous that an angle of inclination of said trumpet-shaped portion of each nozzle from a point of contact with an adjacent nozzle to a place of setting on said tube continually decreases to zero.

A specifically advantageous shape of the intake nozzle, namely of the inner surface of the intake nozzle is obtained when the length of the nozzle and the charging diameter thereof are defined by the following equation:

$$d_x = d_o + (d_H - d_o) \cdot e^{-(\frac{H}{x} - 1)},$$

wherein (FIG. 1):

$d_x$ is a changing inner diameter of the nozzle over the length of the nozzle;

$d_H$ is the greatest inner diameter of the nozzle;

$d_o$ is the smallest timer diameter of the nozzle corresponding to the inner diameter of the heat excharger tube;

H is the length of the intake nozzle; and

X is the length of the intake nozzle at the place X for $d_X$.

According to the equation the contour of the intake nozzle changes in accordance with the course of the exponent curve which describes a uniform and continual transition to the axis of the stream and tube axis and makes the intake nozzle easy to manufacture. Due to this structure a stream constriction is prevented; recirculation and erosion due to solid particles are reduced to minimum.

The problem for realizing the heat exchanger of the invention resides in a displacement-free, coaxial mounting of the nozzle on the heat exchanger tube because manufacture tolerances are not excluded and the displacement causes the danger of deflection of the stream with resulting vortex and abrasion in the heat exchanger tube.

It has been known that only such non-uniformities in the gas stream are damaging which cause extension in the direction normal to the direction of the gas stream greater than the thickness of the laminar stream boundary layer which is formed between the wall and the turbulent stream in the inner part of the stream. The thickness of this laminar boundary layer which leads in the proximity of the wall to speed reduction of the stream down to zero depends upon the length along the wall of the nozzle and increases with this length.

If now disturbance of the laminar stream in the intake nozzle is avoided, and a negative effect on the material stability is prevented the length of the nozzle must be selected so that all non-uniformities be avoided. Such non-uniformities occur also upon the mounting of the intake nozzle at the transition zone between the nozzle and the heat exchanger tube. The thickness of the boundary layer at this transition zone must be greater than the deviation of the workpiece from the ideal size due to manufacture tolerances. For example a step can be formed at the transition between the nozzle and the tube.

It is advantageous that the length of each intake nozzle is selected so that a laminar boundary-thickness between 1.0 and 0.2 mm is formed.

In a further modification of the present invention, adjacent intake nozzles may be in sharp-edged contact with each other, each nozzle being rounded towards a point of contact with an adjacent nozzle with a radius which does not exceed 5 mm. Due to such a structure the areas of dammed water lying normal to the stream direction are minimized and a non-disturbed laminar underlayer can be formed. This feature as well as the limiting of the nozzle angle to 14° must be realized independently from the tube arrangement of the heat exchanger that is not only 90° or 60°—spacing of the tubes is possible but also any other spacing. With the 60°—spray the intake nozzle widens further from a rounded to a hexagonal cross-section, however the limitation of the angle to 14° remains the same for the hexagonal shape. For the inner circumference of the hexagonal nozzle the angle is naturally smaller.

The heat exchanger according to the invention should meet the following requirements:

1. The intake nozzle must be concentrically mounted on the tube and be connected to the tube substantially without displacement, that is with the step which is smaller than the boundary layer thickness, whereby the heat exchanger tube extends by about 10 mm over the tube base.

2. The intake nozzle and the heat exchanger tube must be reliably connected to each other by a form-locking or force-locking connection, so that dust will not penetrate the joint and destroy the wall stream by expanding the slots despite thermal expansion and shrinkage. It is particularly important when the axis of the heat exchanger is inclined to the vertical and the heat exchanger is loaded with gravity components.

3. The individual intake nozzles must be inserted into the tubes so that, in accordance with the tube arrangement on the heat exchanger, a hexagonal or square pattern in the plane of the gas stream inlet could be obtained.

4. If the weld seams between the heat exchanger tube and the tube base are not tight there must be a possibility that individual intake nozzles could be removed.

The nozzles may be releasably mounted on the respective heat exchanger tubes.

Locking means may be provided for mounting each nozzle on the respective tube, said locking means including a centering ring and a bayonet—type locking device connecting said ring to the heat exchanger tube, the intake nozzle being inserted into said centering ring and connected thereto by spot welding.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
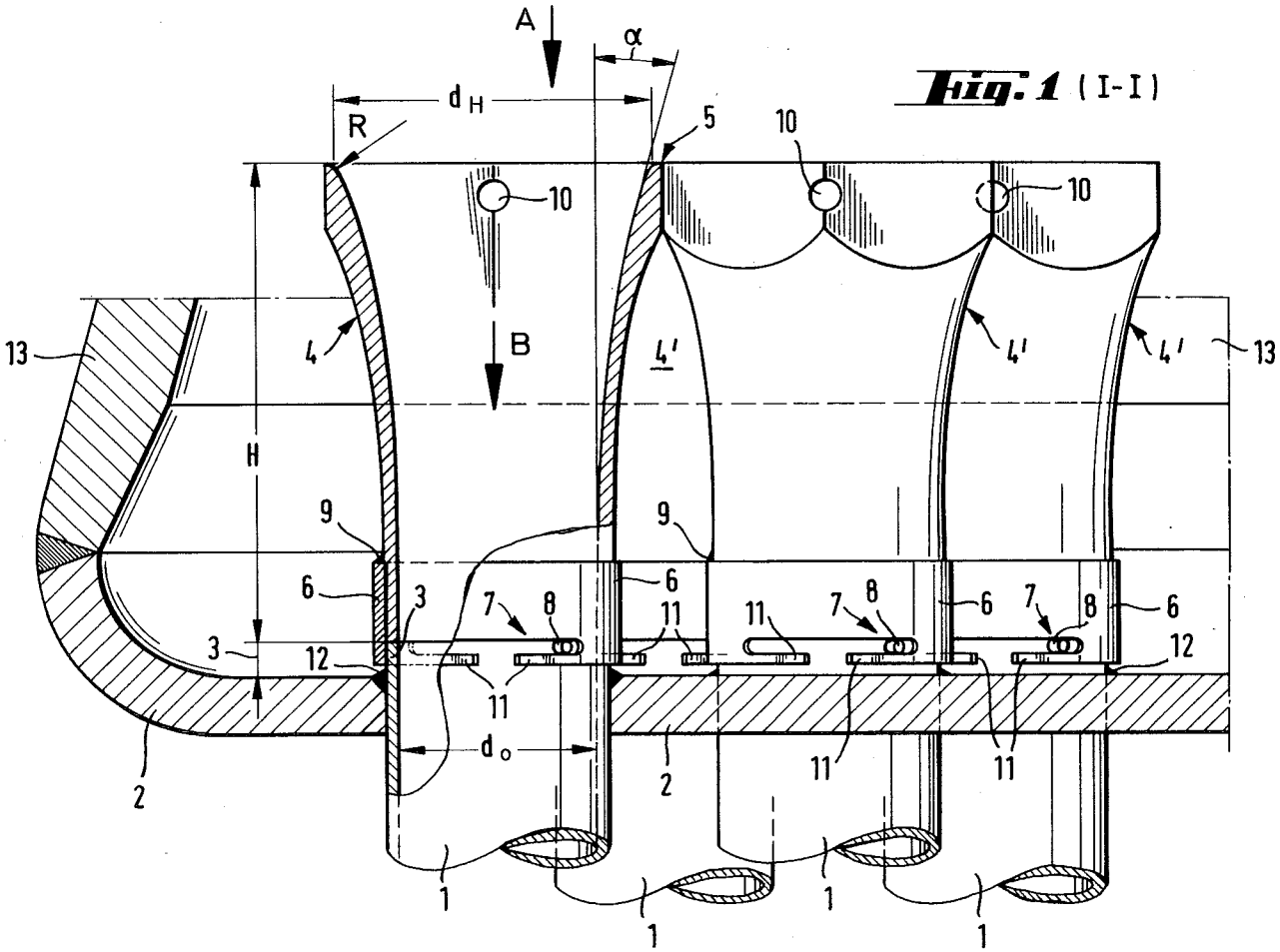
FIG. 1 is an axial view, partially in section of an intake nozzle and a heat exchanger tube inserted in a tubular base.
Figure 2:
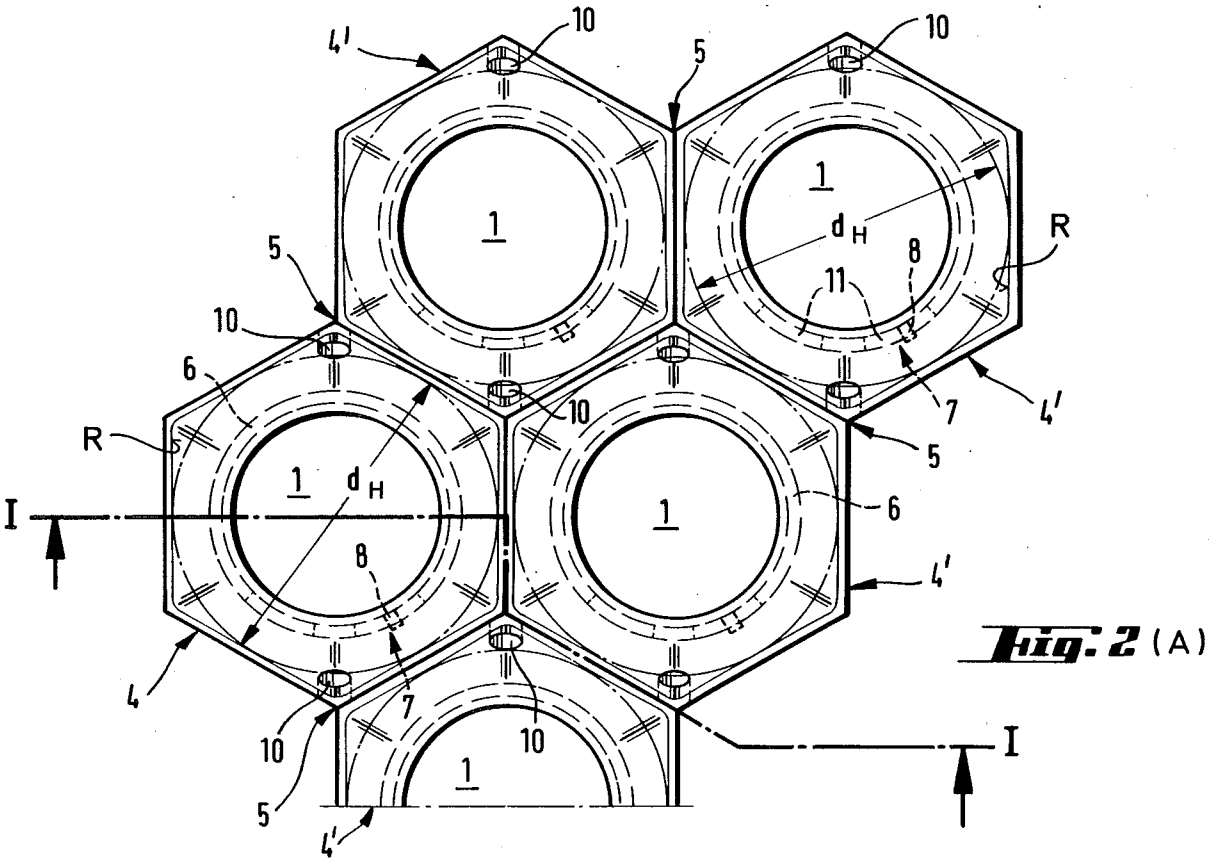
FIG. 2 is a view seen in the direction of arrow A according to FIG. 1.

Referring now to the drawings in detail it will be seen that a heat exchanger tube 1 is welded to a tubular base 2 so that a tubular stump 3, being 10 to 15 mm long extends over a tubular base. An intake nozzle 4 according to the invention is releasably-mounted on the heat exchanger 1 or the tube stump 3. The intake nozzle widens in the trumpet-shaped manner in the direction opposite to the direction of the flow of solid-loading gas (arrow B) up to the contact with neighboring or adjacent intake nozzles, one of which is shown in FIG. 1 and designated by reference numeral 4'. In order to practically prevent the formation of areas of dammed water at the places of contact with adjacent nozzles, which are denoted by R each intake nozzle is rounded. The adjacent intake nozzles 4, 4' form the arrangement with a 60° spacing as shown in FIG. 2.

The connection of each intake nozzle 4, 4' to the heat exchanger tube 1 is carried out by means of a centering ring 6 which is concentrically cuffed over the tubular stump 3. The centering ring has a bayonet-type locking device 7 which, upon the rotation of the centering ring enables a form-locking connection between the slots provided in the locking device 7 and a locking pin 8 provided on the tubular stump 3.

The intake nozzle 4 which is in accordance with the dimensions of the centering ring 6 turned off, is inserted into the centering ring and is secured thereto by a weld 9. All intake nozzles 4 up to the last one can be in this fashion inserted in the respective centering rings and welded thereto respectively. With the last intake nozzle only the centering ring 6 can be locked and the fixing of the intake nozzle with the centering ring will be obviously not possible for space reasons. In this case the fixing takes place at the point of contact between the neighboring intake nozzles. This region of contact is designated by reference numeral 5.

When individual intake nozzles 4 or 4' are to be removed a suitable tool is inserted into one of bores 10 provided in the nozzles. A pulling force can be exerted on such a tool. Thereby flanks 11 of the locking device 7 are formed, and the connection between the intake nozzle 4 and the heat exchange tube 1 is released under the action of that pulling force.

The adjacent intake nozzles can be removed accordingly so that the tubular base 2 can be released for local repair. After the repair, for example one weld seam 12 between the heat exchanger tube and the tubular base 2 can be made to assemble the intake tubes.

The intermediate spaces between the intake nozzles are filled with a heat-resistant mineral fibrous material in order to prevent an inflow of dust into the locking device. The transition area between the intake nozzle 4 and a boiler wall 13 is covered with ceramic fibrous material and a layer of fired concrete, whereby due to the arrangement of fibrous felt parallel to the outer contour of the nozzle penetration of the fired concrete between the intake nozzles is prevented.

It will be understood that each of the elements described above, or tow or more together, may also find a useful application in other types of heat exchangers for cooling a solid-containing gas differing from the types described above.

While the invention has been illustrated and described as embodied in a heat exchanger for cooling a solid-containing gas, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A heat exchanger for cooling solid substance-containing gases, particularly gases discharged from a carbon-gasification plant, comprising a plurality of heat exchange tubes through which gases flow; tube bases into which said heat exchange tubes are inserted at a gas inlet side and gas outlet side; a plurality of intake nozzles each mounted coaxially with and set on a respective heat exchange tube at said gas inlet, each nozzle having an inner diameter, at a portion thereof set on the heat exchange tube, equal to the inner diameter of the heat exchange tube, each nozzle starting from said portion widening in the direction opposite to a direction of gas flow to a place of contact with all adjacent nozzles so as to form a trumpet-shaped portion, said nozzles being releasably mounted on the respective heat exchange tubes; and locking means for mounting each nozzle on the respective tube, said locking means including a centering ring and a bayonet-type locking device connecting said ring to the heat exchange tube, the intake nozzle being inserted into said centering ring and connected thereto by spot welding.

2. The head exchanger as defined in claim 1, wherein said trumpet-shaped portion includes with the direction of the stream of the solid-substance containing gases an angle which does not exceed 14°.

3. The heat exchanger as defined in claim 1, wherein an angle of inclination of said trumpet-shaped portion of each nozzle from a point of contact with an adjacent nozzle to a place of setting on said tube continually decreases to zero.

4. The heat exchanger as defined in claim 1, wherein the length of each intake nozzle is selected so that a liminar boundary-thickness in the range of 1.0 mm is formed.

5. The heat exchanger as defined in claim 1, wherein adjacent intake nozzles are in sharp-edged contact with each other, each nozzle being rounded with a radius of at most 5 mm in the direction towards a point of contact with an adjacent nozzle.

6. A heat exchanger for cooling solid substance-containing gases, particularly gases discharged from a carbon-gasification plant comprising a plurality of heat exchange tubes through which gases flow; tube bases into which said heat exchange tubes are inserted at a gas inlet side and gas outlet side; and a plurality of intake nozzles each mounted coaxilly with and set on a respective heat exchange tube at said gas inlet, each nozzle having an inner diameter, at a portion thereof set on the heat exchanger tube, equal to the inner diameter of the heat exchange tube, each nozzle starting from said portion widening in the direction opposite to a direction of gas flow up to a place of contact with all adjacent nozzles so as to form a trumpet-shaped portion, said trumpet-shaped portion including with the direction of the stream of the solid-substance containing gases an angle which does not exceed 14°, and wherein an angle of inclination of said trumpet-shaped portion of each nozzle from a point of contact with an adjacent nozzle to a place of setting on said tube continually decreases to zero, said nozzles being releasably mounted on the respective heat exchanger tubes, wherein locking means are provided for mounting each nozzle on the respective tube, said locking means including a centering ring and a bayonet-type locking device connecting said ring to the heat exchanger tube, the intake nozzle being inserted into said centering ring and connected thereto by spot welding.

* * * * *